United States Patent [19]

Weirauch

[11] 4,447,393

[45] May 8, 1984

[54] OXIDE-FREE CDTE SYNTHESIS

[75] Inventor: Donald F. Weirauch, Dallas, Tex.

[73] Assignee: Texas Instruments Incorporated, Dallas, Tex.

[21] Appl. No.: 465,129

[22] Filed: Feb. 9, 1983

[51] Int. Cl.[3] ..... C22C 1/02; C22C 20/00

[52] U.S. Cl. ..... 420/590; 420/525; 420/579; 420/903

[58] Field of Search ..... 420/525, 526, 579, 903, 420/590; 75/71

[56] References Cited

U.S. PATENT DOCUMENTS

| | | | |
|---|---|---|---|
| 2,862,787 | 12/1958 | Sequin et al. | 420/579 |
| 2,953,690 | 9/1960 | Lawson et al. | 420/526 |
| 4,077,799 | 3/1978 | Wieking et al. | 75/71 |

*Primary Examiner*—L. Dewayne Rutledge
*Assistant Examiner*—Christopher W. Brody
*Attorney, Agent, or Firm*—Robert Groover; Melvin Sharp; James T. Comfort

[57] ABSTRACT

The problem of CdTe sticking to quartz boats is avoided by preventing any presence of cadmium oxides in the as-compounded CdTe. This is accomplished by distilling the cadmium under a high vacuum immediately prior to the CdTe compounding step.

8 Claims, 1 Drawing Figure

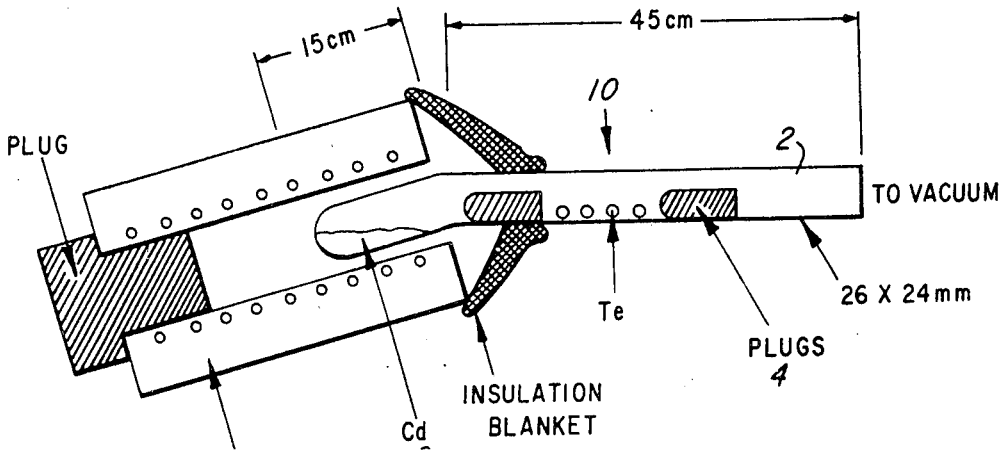
15cm
45cm
10
2
PLUG
TO VACUUM
Te
26 X 24mm
PLUGS
4
INSULATION
BLANKET
Cd

OXIDE-FREE CDTE SYNTHESIS

BACKGROUND AND SUMMARY OF THE INVENTION

The present invention relates to a method for preparing CdTe.

The semiconductor CdTe has long been a subject of development interest in the semiconductor art. Its primary application today is as a lattice-matched substrate for HgCdTe infrared imaging devices. For such substrate applications, it is highly desirable to have reasonably large monocrystalline portions of CdTe, so that large epitaxial device regions without grain boundaries can be grown thereon. It is also desirable that the CdTe substrates not include harmful impurities which can diffuse into the HgCdTe active device layers.

One of the first obstacles which has been encountered in the growth of single crystal CdTe is the propensity of CdTe, when compounded from its elements, to adhere tenaciously to fused silica ampoules. The adhesion is so strong that, during cool down from the CdTe melting point (1100 C.) the quartz will fracture into tiny fragments, and it may still be necessary to separate the CdTe from the quartz by force. The usual solution to this problem is to cover the quartz with a carbon coating to effectively prevent direct contact between the quartz and the CdTe.

However, it is undesirable to compound the CdTe in contact with a carbon lining, since the effects of carbon doping in CdTe (and in HgCdTe device structures, which are commonly fabricated on CdTe substrates) are not believed to be beneficial.

Thus it is an object of the present invention to provide a method for compounding CdTe which does not require that the CdTe be compounded in the direct pressure of carbon. If CdTe adheres strongly to the quartz container, so that it must be removed by violent pounding, additional impurities are likely to be introduced by the separation process. Moreover, the whole object of growing large single-crystal masses of CdTe is frustrated if those masses are broken up during the process of removal.

It is a further object of the present invention to provide a method for compounding CdTe, which does not require that CdTe be subjected to damage when removed from quartz containers. The present invention solves this problem by completely avoiding the presence of cadmium oxides in the as-compounded CdTe. When cadmium oxides are not present, the CdTe does not stick to silica. Therefore, an unlined silica ampoule can used, and, after cooling, the CdTe ingot can merely be tipped out.

According to the present invention there is provided:

A method for compounding CdTe, comprising the steps of:

providing high-purity cadmium and Te;

distilling said high-purity Cd under a vacuum; and compounding said Cd and Te to form a melt of CdTe;

wherein said Cd is maintained under vacuum continuously from said distillation step through said compounding step.

BRIEF DESCRIPTION OF THE DRAWINGS

The present invention will be described with reference to the accompanying drawings, wherein:

FIG. 1 shows an apparatus for practicing the method of the present invention.

DESCRIPTION OF THE PREFERRED EMBODIMENTS

The present invention, as noted above, solves the problem of CdTe sticking to silica, by providing the presence of cadmium oxides in the CdTe. It has been found that the cadmium oxides are responsible for the sticking, since they act, in effect, as surfactants to promote wetting of the silica by the CdTe.

It is expected that CdTe should not intrinsicly bond to silica, the intermediary responsible for the bonding of Cdte to silica was initially suspected to be a cadmium oxide. The method of the present invention has therefore been devised specifically to eliminate the presence of cadmium oxides, and has resulted in completely successful elimination of the sticking problem.

Although it is still not known exactly which oxide compound is the intermediary responsible for promoting adhesion, the present invention is completely successful in eliminating sticking.

Elimination of cadmium oxides from CdTe is rather difficult, since cadmium spontaneously reacts with air to form oxide skin or impurities.

The present invention avoids this native oxide by performing a distillation of cadmium under high vacuum prior to compounding. The cadmium is not thereafter exposed to air until it has been compounded. Once an approximately stoichiometric (or Te-rich) CdTe compound has been formed, exposure to air can be permitted, since the native cadmium oxide is not formed by the compound.

The sticking problem is solved by distilling cadmium into an evacuated reaction chamber preloaded with Te, and sealing the chamber while still under vacuum. FIG. 1 illustrates the process. In the presently preferred embodiment the quartz tube 2 and plugs 4 (which facilitate seal-off) are cleaned in concentrated HF for five minutes and then rinsed ten times in deionized water and dried in a drying over. Sixty grams of Cd is introduced into the tube 2 followed, in sequence, by a quartz plug 4, 68.1 grams of Te, and the second quartz plug 4. The tube is evacuated to $10^{-7}$ Torr and the furnace is heated to 700 C. In 45 to 60 minutes (including the heating time) the Cd 6 has evaporated into the Te chamber 10. An oxyhydrogen flame is used to first seal the quartz tube 2 to the plug nearest the bend, followed by actual removal of the tube from the bend using a very hot flame. The same procedure is followed at the second plug 4 which results in a sealed ampoule, approximately ten inches long, containing the charge. This ampoule is then placed into a rocking furnace, heated for one hour to 1120 C., held there for two hours, and then cooled to room temperature in somewhat less than one hour.

The vacuum for Cd distillation need not be as great as $10^{-7}$ Torr. In less preferred embodiments a vacuum as soft as $10^{-2}$ Torr can be used. Alternatively, if inert gasses are introduced, the partial pressure of oxygen under which the cadmium is kept after distillation is preferably less than $10^{-3}$ Torr, but vacuum is not required.

In the presently preferred embodiment, not quite all of the cadmium 6 is distilled. That is, a small percentage of the cadmium (e.g. 0.2%) is preferably left behind, along with a residue of native oxides and other garbage.

In the presently preferred embodiment, the cadmium is distilled twice, and the Te is distilled once (in a separate chamber), before compounding.

The quartz tube 2 used can be, e.g., an inch or an inch and a half in diameter, or larger or smaller. The diameter of the tube is not at all critical, except that it is preferably small enough to permit it to be easily sealed off in the laboratory using a torch.

The present invention necessarily results in somewhat uncertain quantities of the elements being transported into the compounding zone, but it is not critical that the CdTe formed at this step be exactly stoichiometric. A subsequent vacuum anneal is used to assure stoichiometry, which is easily accomplished since the vapor pressure of both cadmium and of Te at elevated temperatures are much higher than that of CdTe.

In fact, it is preferable that the melt as compounded be on the Te-rich side of stoichiometric. This not only provides additional insurance against the subsequent formation of cadmium oxides on exposure to air, but also provides the advantage that the vapor pressure over molten CdTe is substantially lower.

It should be noted that, in one alternative embodiment, the quartz ampoule used is semiconductor-grade (high-purity) quartz. Such quartz, e.g. Spectrosil (TM) is readily commercially available (but is expensive).

As will be obvious to those skilled in the art, the present invention is not limited to the preferred embodiment discussed, but may be practiced in a wide range of modifications and variations, and is therefore not limited except as specified in the following claims.

What is claimed is:

1. A method for compounding CdTe, comprising the steps of:

providing high-purity cadmium and Te;

distilling said high-purity Cd under a vacuum; and compounding said Cd and Te to form a melt of CdTe;

wherein said Cd is maintained under vacuum continuously from said distillation step through said compounding step.

2. The method of claim 1, wherein said Cd is maintained under a vacuum greater than $10^{-2}$ Torr.

3. The method of claim 1, wherein said Cd is maintained under a partial pressure of oxygen which is less than $10^{-3}$ Torr.

4. The method of claim 1, further comprising the subsequent step of:

heating said CdTe compound to above 500° C. and maintaining said CdTe at a elevated temperature, whereby CdTe compound becomes more nearly stoichiometric.

5. The method of claim 1, wherein said CdTe is compounded in a proportion which includes at least as much Te as Cd.

6. A method for compounding CdTe, comprising the steps of:

providing high-purity cadmium and Te;

distilling said high-purity Cd under a vacuum; and compounding said Cd and Te to form a melt of CdTe;

wherein said Cd is maintained under partial pressure of oxygen which is less than $10^{-3}$ Torr continuously from said distillation step through said compounding step.

7. The method of claim 1, wherein said distilling step leaves residues, and further comprising the additional step, subsequent to said distilling step and prior to said compounding step, of:

physically segregating said residues so that said residues are excluded from said melt of CdTe.

8. The method of claim 6, wherein said distilling step leaves residues, and further comprising the additional step, subsequent to said distilling step and prior to said compounding step, of:

physically segregating said residues so that said residues are excluded from said melt of CdTe.

* * * * *